US005369850A

United States Patent [19]

Noble

[11] Patent Number: 5,369,850

[45] Date of Patent: Dec. 6, 1994

[54] CLAMPING ASSEMBLY PROVIDING DIFFERENT DUAL GRIPPING FEATURES

[76] Inventor: Jess J. Noble, 6663 S. Lakeview St., Littleton, Colo. 80120

[21] Appl. No.: 41,824

[22] Filed: Apr. 1, 1993

[51] Int. Cl.[5] ..... E04F 10/00; A44B 11/25

[52] U.S. Cl. ..... 24/335; 24/369; 24/525; 135/88.12; 160/67

[58] Field of Search ..... 24/335, 369, 525; 135/89; 160/22, 66, 67, 68

[56] References Cited

U.S. PATENT DOCUMENTS

| | | | |
|---|---|---|---|
| 1,150,046 | 8/1915 | Lloyd | 24/335 |
| 1,494,658 | 5/1924 | Willwerscheid | 24/569 |
| 1,726,790 | 9/1929 | Andrews | 24/335 |
| 2,281,522 | 4/1942 | Jaynes . | |
| 3,185,509 | 5/1965 | Welsher et al. . | |
| 3,186,051 | 6/1965 | Waddell . | |
| 4,097,169 | 6/1978 | Kelly . | |
| 4,718,266 | 1/1988 | Jarman et al. | 24/569 |
| 4,805,938 | 2/1989 | Redmond et al. | 24/569 |
| 5,246,052 | 9/1993 | Homan | 160/67 |

FOREIGN PATENT DOCUMENTS

| | | | |
|---|---|---|---|
| 1086247 | 2/1955 | France | 24/569 |

*Primary Examiner*—Richard E. Gluck
*Assistant Examiner*—Roland G. McAndrews, Jr.
*Attorney, Agent, or Firm*—John R. Flanagan

[57] ABSTRACT

A clamping assembly includes a pair of elongated upper and lower clamping members each having a pair of first and second transverse channels being spaced from one another and formed in confronting faces of the clamping members, a pair of gripping plates being disposed in the second channels of the clamping members, and a fastener releasably connect the upper and lower clamping members together at middle portions thereof extending between the first and second channels of the clamping members for providing simultaneously dual gripping of a portion of an awning between the gripping plates in the second channels of the clamping members and of an awning support brace portion between the clamping members in the first channels thereof.

20 Claims, 2 Drawing Sheets

CLAMPING ASSEMBLY PROVIDING DIFFERENT DUAL GRIPPING FEATURES

BACKGROUND OF THE INVENTION

1. Field of the Invention

The present invention generally relates to clamping devices and, more particularly, is concerned with a clamping assembly providing different dual gripping features for use with awning equipment accompanying recreational vehicles, mobile homes and the like.

2. Description of the Prior Art

A varied assortment of clamping devices, covering a wide range of structural configurations, have been developed to meet important needs in such diverse settings as industrial plants, scientific laboratories and boating marinas. In the industrial setting, for example, clamping devices have found use on production lines for the efficient manufacture of such materials as floor and wall coverings. Other industrial uses may include clamping device arrangements to stabilize piping and tubing systems in a factory or industrial plant.

Representative examples of such clamping devices are disclosed in U.S. patents to Jaynes (2,281,522), Welsher et al (3,185,509), Waddell (3,186,051) and Kelly (4,097,169). The device of the Jaynes patent has dual gripping features for use in the production of floor and wall coverings. Two adjacent thin sheets of the floor or wall covering are gripped simultaneously by this clamping device. Such action permits these adjacent sheets to move through the fabrication process, in an efficient manner, as a continuous sheet of extreme length.

The device of the Welsher et al patent provides a clamping structure for laboratory use. This device is a unitary structure which provides a first feature for interlocking with another such device or with a projection on a base plate. The device also provides a second feature for holding various attachments such as rods or other means for gripping flasks, beakers, and the like.

The device of the Waddell patent is comprised of two complementary identical halves providing features for clamping together a plurality of tubes of various diameters in alignment with one another. This device is most suitable for use with pneumatic control systems in plants and factories for stabilizing a plurality of tubing lines running from the field to the control building.

The device of the Kelly patent provides a first feature particularly for gripping very smooth plastic sleeve material, such as polyethylene, although suitable also for gripping canvas tarpaulins. A second feature of the device provides anchoring means using cord or rope for securing the sheet material over a vehicle or boat.

None of the above-described clamping devices include features which address the particular requirements for securing awning equipement on vehicles such as recreational vehicles or on mobile homes so as to withstand excessive wind pressure on the awning. None of these devices include dual gripping features designed of such complementary shape as to grip, one the one hand, an awning support brace portion, being rectangularly or similarly shaped in cross-section and, on the other hand, a thin edge portion of awning fabric such that the awning edge is maintained in a level position consistent with the fully deployed awning. The Kelly device, for example, does not meet this requirement as an edge portion of an awning could not be sufficiently wrapped around a rod for giving, as in the Kelley device, without potentially damaging the over fabric structure of the awning in its deployed position. Moreover, the awkwardness involved in attempting such use of the Kelly device further serves to eliminate the Kelly device from consideration for use with this type of awning equipment.

Consequently, a need exists for a clamping device of such design as to provide dual gripping features for simultaneous use on both an awning and awning support brace. Such gripping features must enhance the capability of the awning equipment to withstand damage from varying weather conditions such as unexpected wind gusts and the like. The device must be simple in design and construction for inexpensive manufacture and for ease in use by the average person.

SUMMARY OF THE INVENTION

The present invention provides a clamping assembly designed to satisfy the aforementioned need by avoiding the drawbacks of the prior art without introducing other drawbacks. Instead the clamping assembly of the present invention provides expanded capabilities not available in the prior art devices.

One capability is the simplicity in design and construction of the clamping assembly for inexpensive manufacture and ease in use by the average person in everyday life. A second capability is the simple fastening and releasability features of the assembly for quick adjustment of the clamping assembly on the awning equipment where necessary. A third capability is the simultaneous different dual gripping features provided by the clamping assembly on both the awning and awning support brace for enhancing the capability of this awning equipment to withstand wind damage.

Accordingly, the present invention is directed to a clamping assembly for use in securing an awning to an awning support brace. The clamping assembly comprises: (a) a pair of elongated upper and lower clamping members, each of the clamping members having a pair of first and second opposite ends, a pair of opposite faces and a pair of first and second transverse channels, the first and second channels being formed in a spaced relation to one another in a same one of the opposite faces; (b) a pair of gripping plates being disposed in a facing relation to one another in the second channels of the respective clamping members; and (c) fastening means for releasably connecting the clamping members together for simultaneously gripping a portion of an awning between the gripping plates disposed in the second channels of the clamping members and a portion of an awning support brace between the clamping members in the first channels thereof.

More particularly, the first transverse channel of each clamping member is spaced from the first opposite end of the clamping member and is shaped to fit over a longitudinal portion of the awning support brace. The second transverse channel of each clamping member is spaced from the first transverse channel of the clamping member and extends to the second opposite end of the clamping member. Each clamping member has a middle portion extending between the first and second spaced apart channels. The middle portions of the respective clamping members are disposed in a contacting flush relationship with one another when the clamping members are connected together by the fastening means.

The fastening means includes an elongated fastener and a pair of central passageways each extending through the middle portion of one of the clamping members and between the opposite faces thereof. The central passageways are alignable axially with one another for receiving the fastener therethrough to releasably connect the clamping members together.

The gripping plates are disposed in the second transverse channels of the clamping members and have confronting faces extending in substantially parallel relationship to one another. Also, the confronting faces of the gripping plates can be coated with a material, such as a fabric or rubber, to provide a nonslip frictional gripping surface. The gripping plates are inserted over opposite sides of an edge portion of the awning such that the fabric of the awning edge portion is positioned between and extends parallel to the coated inner faces of the gripping plates.

With the upper and lower clamping members connected together, the upper and lower clamping members clamp against the opposite sides of the longitudinal portion of the awning support brace extending through the first channels of the upper and lower clamping members. Also, with the upper and lower clamping members connected together, the upper and lower gripping plates extending through the second channels of the upper and lower clamping members clamp against the opposite faces of the edge portion of the awning extending between the gripping plates.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
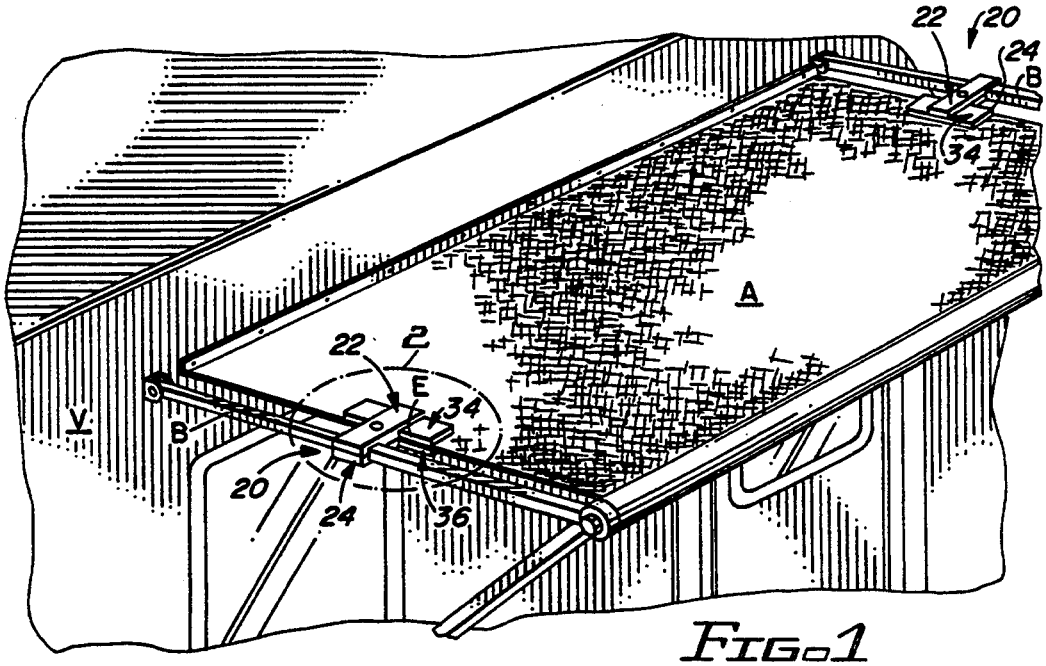
FIG. 1 is a perspective view of a pair of clamping assemblies of the present invention attached to an awning and a pair of awning support braces mounted to the side of a vehicle, such as a recreational vehicle.

Referring to the drawings and particularly to FIG. 1, there is illustrated a pair of clamping assemblies of the present invention, being generally designated 20, for use in securing an awning A at portions of opposite edges E thereof to a pair of awning support braces B. The awning A and awning support braces B, to which the clamping assembly 20 is applied, are attached to and deployable from the side of a vehicle V, such as a motor home or recreational vehicle. As shown in FIG. 1, a plurality of the clamping assemblies 20, as needed, may be secured across portions of the awning support braces B and adjacent the awning edges E such that the fully deployed awning A thereby is strengthened at different locations against powerful wind forces.

Figure 2:
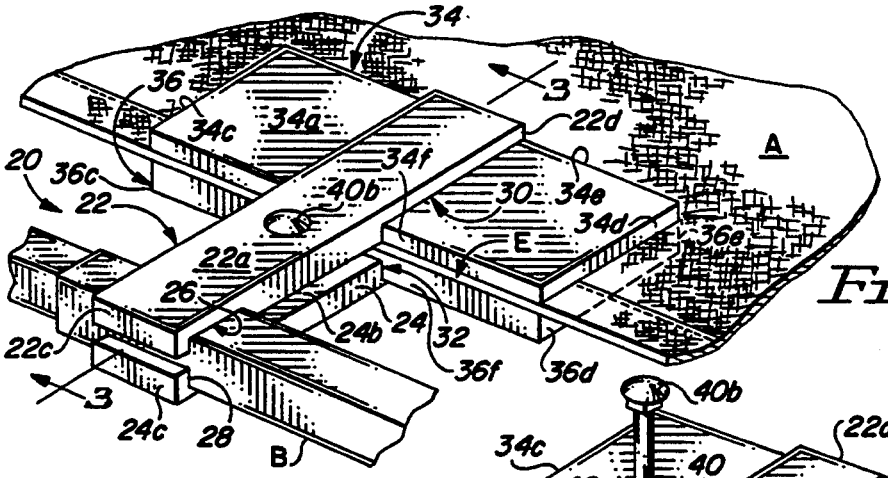
FIG. 2 is an enlarged top perspective view of the one clamping assembly shown enclosed in circle 2 of FIG. 1.
Figure 3:
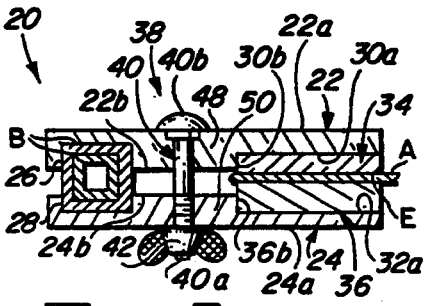
FIG. 3 is a longitudinal sectional view of the clamping assembly taken along line 3—3 of FIG. 2.
Figure 4:
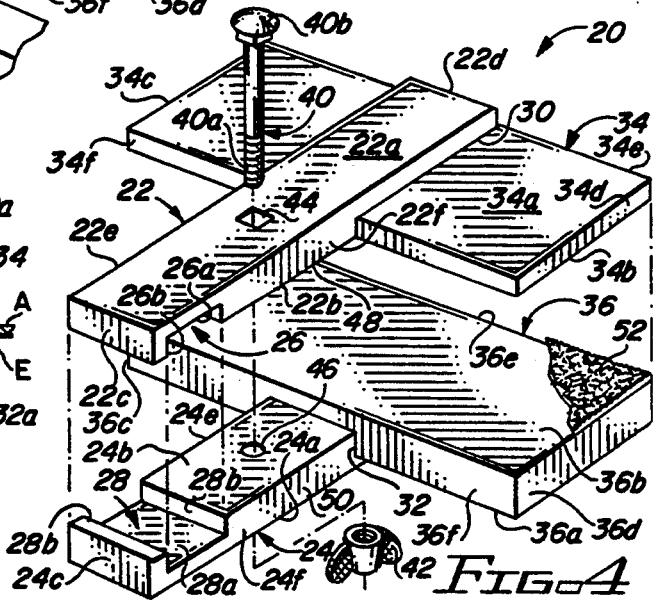
FIG. 4 is an exploded perspective view of a first embodiment of the clamping assembly.

In its basic components, the clamping assembly 20 includes a pair of upper and lower clamping members 22, 24, each having a first transverse channel 26, 28 and a second transverse channel 30, 32 defined therein. The clamping assembly 20 further includes a pair of upper and lower gripping plates 34, 36 disposd in the second transverse channels 30, 32 of the upper and lower clamping members 22, 24, and fastening means 38 for releasably fastening the upper and lower clamping members 22, 24 together, as seen in FIGS. 2–4. The fastening means 38 preferably includes an elongated fastener in the form of a bolt 40 with external threads on one end **40*a* and an enlarged head 40*b* on the opposite end and a wing nut 42 threadable on threaded end 40*a* of the bolt 40. The fastening means 38 also includes a pair of central passageways 44, 46 extending through respective middle portions 48, 50 of the upper and lower clamping members 22, 24 and between the opposite faces 22*a*, 22*b* and 24*a*, 24*b* thereof. The central passageways 44, 46 are alignable axially with one another for receiving the fastener 40 therethrough to releasably connect the clamping members 22, 24** together.

Referring particularly to FIGS. 2 and 4, the upper and lower clamping members 22, 24 have substantially identical rectangular configurations. Each clamping member 22, 24 has the opposed outer and inner faces **22*a*, 22*b* and 24*a*, 24*b* extending between pairs of first and second opposite ends 22*c*, 22*d* and 24*c*, 24*d* and pairs of opposite side edges 22*e*, 22*f* and 24*e*, 24*f* of the upper and lower clamping members 22, 24. The inner faces 22*b*, 24*b* of the upper and lower clamping members confront or face toward one another. The outer faces 22*a*, 24*a* of the upper and lower clamping members 22, 24** are substantially flat planar surfaces.

The first transverse channels 26, 28 are in the form of substantially identical elongated rectangular-shaped recesses defined in the confronting inner faces **22*b*, 24*b* of the clamping members 22, 24 by bottom surfaces 26*a*, 28*a* spaced from the outer faces 22*a*, 24*a* of the clamping members 22, 24 and respective pairs of spaced side surfaces 26*b*, 28*b* extending perpendicular to and along opposite edges of the bottom surfaces 26*a*, 28*a*. The first transverse channels 26, 28 are respectively spaced from the first opposite ends 22*c*, 24*c* of the upper and lower clamping member 22, 24 and extend between the opposite side edges 22*e*, 22*f* and 24*e*, 24*f*** respectively thereof.

The second transverse channels 30, 32 are in the form of substantially identical elongated rectangular-shaped recesses defined in the confronting inner faces **22*b*, 24*b* of the clamping members 22, 24 at the opposite side of the middle portions 48, 50 from the first transverse channels 26, 28 and extending to the second opposite ends 22*d*, 24*d* of the upper and lower clamping members 22, 24 and between the opposite side edges 22*e*, 22*f* and 24*e*, 24*f* thereof. The second transverse channels 30, 32 have bottom surfaces 30*a*, 32*a* spaced from the outer faces 22*a*, 24*a* of the clamping members 22, 24 and respective end surfaces 30*b*, 32*b* extending along and perpendicular to one edge of the bottom surfaces 30*a*, 32*a*. The bottom surfaces 26*a*, 28*a* of the first transverse channels 26, 28 are substantially equal to one another in width, but less in width than the bottom surfaces 30*a*, 32*a*, of the second transverse channels 30, 32**.

The middle portions 48, 50 of the clamping members 22, 24 respectively extend between the first and second spaced apart channels 26, 30 and 28, 32 therein. The middle portions 48, 50 are disposed in a contacting flush relationship with one another when the clamping members 22, 24 are connected together by the fastening means 38.

Referring further to FIGS. 2–4, the pair of upper and lower gripping plates 34, 36 have respective rectangular configurations, are of substantially the same size, and having opposed outer and inner planar faces 34*a*, 34*b* and 36*a*, 36*b* extending between pairs of opposite ends and side edges 34*c*, 34*d* and 34*e*, 34*f* on the first gripping plate and 36*c*, 36*d* and 36*e*, 36*f* on the second gripping plate, as seen in FIG. 4. The first gripping plate 34 is of lesser thickness than the second gripping plate 36. The widths of the second transverse channels 30, 32 are matched with the widths of the gripping plates 34, 36 such that upper gripping plate 34 snugly seats through the second transverse channel 30 of the upper clamping member 22 and the other gripping plate 36 snugly seats through the second transverse channel 32 of the lower clamping member 24.

Thus, the upper and lower clamping members 22, 24 together substantially enclose and secure the longitudinal portion of the awning support brace B within the facing first transverse channels 26, 28 of the clamping members 22, 24. The upper and lower clamping members 22, 24 further secure the edge portion E of the awning A between the upper and lower gripping plates 30, 32 being received through the second transverse channels 30, 32 of the clamping members 22, 24. The above-described bolt 40 and wing nut 42 of the fastening means 38 are utilized to releasably secure the upper and lower clamping member 22, 24 together at their middle portions 48, 50 such that the clamping assembly 20 simultaneously grips both the awning A and the awning support brace B, as hereinbefore described. The different thicknesses of the gripping plates 34, 36 permits the gripped edge portion E of the awning A to be maintained in a level condition with the remainder of the awning A.

As shown in FIGS. 2–4, the upper and lower clamping members 22, 24 and the gripping plates 34, 36 can be fabricated from solid blocks of a suitable material, such as wood. Alternatively, the upper and lower clamping members 22, 24 and the gripping plates 34, 36 may be fabricated from hollow tubular material, such as aluminum tubing. The inner faces 34*b*, 36*b* of the gripping plates 34, 36 can be coated with a non-slip gripping material 54, such as fabric or rubber, to enhance the frictional gripping capability of the inner faces of the plates. The bolt and wing nut 40, 42 can be made of stainless steel.

Figure 5:
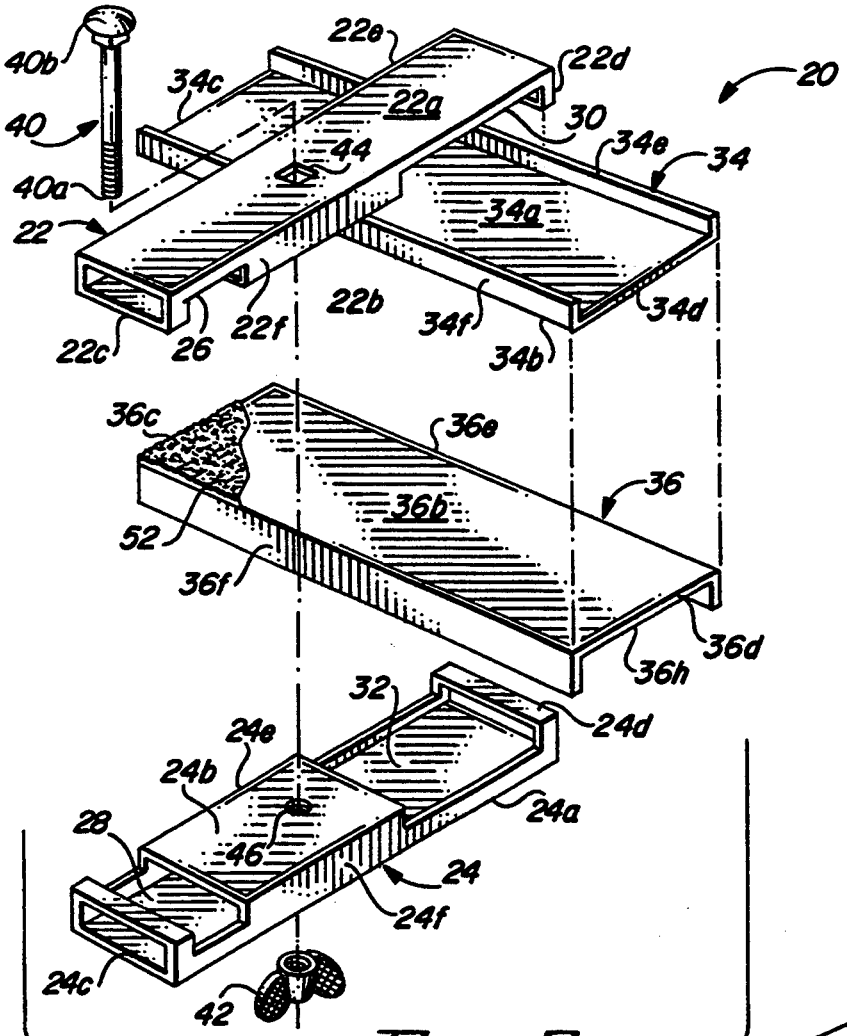
FIG. 5 is an exploded perspective view of a second embodiment of the clamping assembly.
Figure 6:
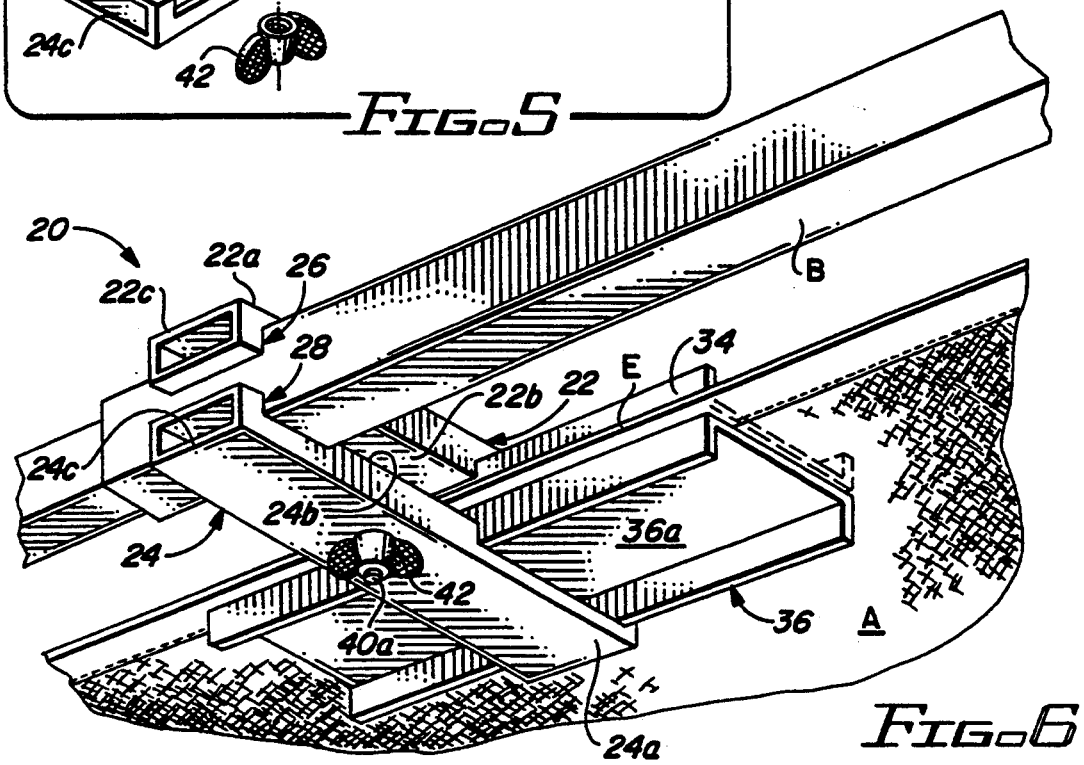
FIG. 6 is a bottom perspective view of the second embodiment of the clamping assembly.

Referring to FIGS. 5 and 6, in an alternative or second embodiment of the clamping assembly 20, the upper and lower clamping members 22, 24 and gripping plates 34, 36 are fabricated from the hollow tubing. Overall, the configurations of the upper and lower members 22, 24 and of the gripping plates 34, 36 in this second embodiment, as seen in FIG. 5, are substantially the same as in the first embodiment of FIGS. 2–4. However, instead of being in the form of recesses in the solid clamping members 22, 24 of the first embodiment, the first and second transverse channels 26, 28 and 30, 32 are in the form of rectangular openings defined in the hollow tubular clamping members 22, 24 of the second embodiment. Also, the gripping plates 34, 36 in the alternative embodiment seen in FIGS. 5 and 6 have U-shaped cross-sectional shapes. Nonetheless, the functioning of the clamping members 22, 24 and gripping plates 34, 36 remains the same as in the first embodiment. Also, the inner planar faces 34*b*, 36*b* can be coated with the non-slip gripping material 52, as hereinbefore described with respect to the first embodiment, for enhancement of the gripping capability of the gripping plates 34, 36 within the clamping assembly 20.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A clamping assembly for use in securing an awning to an awning support brace, said clamping assembly comprising:

(a) a pair of elongated clamping members, each of said clamping members having a pair of first and second opposite ends, a pair of opposite faces and a pair of first and second transverse channels, said first and second channels being formed in a spaced relation to one another in a same one of said opposite faces;

(b) a pair of gripping plates being disposed in a facing relation to one another in said second channels of said respective clamping members; and (c) fastening means for releasably connecting said clamping members together for simultaneously gripping a portion of an awning between said gripping plates disposed in said second channels of said clamping members and a portion of an awning support brace between said clamping members in said first channels of said clamping members.

2. The assembly of claim 1 wherein said gripping plates when disposed in said second transverse channels of said clamping members have confronting faces being coated with a material providing a non-slip frictional gripping surface.

3. The assembly of claim 1 wherein said gripping plates disposed in said second transverse channels of said clamping members have confronting faces extending in substantially parallel relation to one another.

4. The assembly of claim 1 wherein said clamping members have substantially identical rectangular configurations.

5. The assembly of claim 1 wherein said gripping plates are rectangular in shape.

6. The assembly of claim 1 wherein said gripping plates have substantially the same length.

7. The assembly of claim 1 wherein said clamping members are elongated solid rectangular-shaped members.

8. The assembly of claim 7 wherein said first and second channels are rectangular-shaped recesses formed in said one of said opposite faces of each of said clamping members.

9. The assembly of claim 1 wherein said clamping members are elongated rectangular-shaped hollow members.

10. The assembly of claim 9 wherein said first and second channels are rectangular openings formed in said one of said opposite faces of each of said clamping members.

11. The assembly of claim 1 wherein said first transverse channel of each of said clamping members is spaced from said first opposite end of said clamping member and shaped to fit over a longitudinal portion of the awning support brace.

12. The assembly of claim 11 wherein said second transverse channel of each of said clamping members is spaced from said first transverse channel of said clamping member and extends to said second opposite end of said clamping member.

13. The assembly of claim 12 wherein one of said gripping plates has a thickness which is less than a thickness of the other of said gripping plates.

14. The assembly of claim 1 wherein each of said clamping members has a middle portion extending between said first and second spaced apart channels.

15. The assembly of claim 14 wherein said middle portions of said respective clamping members are disposed in a facing relationship with one another when said clamping members are connected together by said fastening means.

16. The assembly of claim 14 wherein said fastening means includes:

an elongated fastener; and a pair of central passageways each extending through said middle portion of one of said clamping members and between said opposite faces thereof, said central passageways being alignable axially with one another for receiving said fastener therethrough to releasably connect said clamping members together.

17. A clamping assembly for use in securing an awning to an awning support brace, said clamping assembly comprising:

(a) a pair of elongated clamping members, each of said clamping members having a pair of first and second opposite ends, a pair of opposite faces and a pair of first and second transverse channels, said first and second channels being formed in a spaced relation to one another in a same one of said opposite faces;

(b) a pair of gripping plates being disposed in a facing relation to one another in said second channels of said respective clamping members; and (c) fastening means for releasably connecting said clamping members together for simultaneously gripping a portion of an awning between said gripping plates disposed in said second channels of said clamping members and a portion of an awning support brace between said clamping members in said first channels thereof;

(d) said first transverse channel of each of said clamping members being spaced from said first opposite end of said clamping member and shaped to fit over a longitudinal portion of the awning support brace;

(e) said second transverse channel of each of said clamping members being spaced from said first transverse channel of said clamping member and extending to said second opposite end of said clamping member;

(f) each of said clamping members having a middle portion extending between said first and second spaced apart channels, said middle portions of said respective clamping members being disposed in a facing relationship with one another when said clamping members are connected together by said fastening means.

18. The assembly of claim 17 wherein said gripping plates when disposed in said second transverse channels of said clamping members have confronting faces being coated with a material providing a non-slip frictional gripping surface.

19. The assembly of claim 17 wherein said gripping plates when disposed in said second transverse channels of said clamping members have confronting faces extending in substantially parallel relation to one another.

20. The assembly of claim 17 wherein said fastening means includes:

an elongated fastener; and a pair of central passageways each extending through said middle portion of one of said clamping members and between said opposite faces thereof, said central passageways being alignable axially with one another for receiving said fastener therethrough to releasably connect said clamping members together.

* * * * *